US005447049A

United States Patent [19]

Shieh

[11] Patent Number: 5,447,049

[45] Date of Patent: Sep. 5, 1995

[54] PUSH-BUTTON LOCKING DEVICE

[76] Inventor: Jin-Ren Shieh, No. 178, Shih Chia Rd., Taichung, Taiwan

[21] Appl. No.: 188,850

[22] Filed: Jan. 31, 1994

[51] Int. Cl.[6] ..... E05B 27/08

[52] U.S. Cl. ..... 70/360; 70/DIG. 20; 70/DIG. 79; 70/491

[58] Field of Search ..... 70/360, 361, 491, DIG. 27, 70/DIG. 56, DIG. 20, DIG. 79, 367, 370–372, 419

[56] References Cited

U.S. PATENT DOCUMENTS

| | | | |
|---|---|---|---|
| 2,046,831 | 7/1936 | Lowe | 70/DIG. 20 |
| 3,910,082 | 10/1975 | Patriquin | 70/DIG. 79 |
| 4,009,599 | 3/1977 | Patriquin | 70/DIG. 20 |
| 4,418,554 | 12/1983 | Wolfgang | 70/361 |
| 5,020,349 | 6/1991 | Lee | 70/419 |
| 5,036,683 | 8/1991 | Geuvjehizian | 70/360 |
| 5,133,203 | 7/1992 | Huang | 70/360 |
| 5,349,835 | 9/1994 | Liao | 70/419 |

*Primary Examiner*—Peter M. Cuomo
*Assistant Examiner*—Barnell M. Boucher
*Attorney, Agent, or Firm*—Browdy and Neimark

[57] ABSTRACT

An improved push-button locking device has an outer sleeve in which an inner sleeve is received. The inner sleeve is used to receive therein a locking rod, a front ring seat, a rear ring seat, and a plurality of front and rear retaining tenons and urging springs. The outer sleeve is provided in the wall thereof with a bar hole. A locating pin is fastened to the wall of the inner sleeve such that the locating pin extends into the bar hole for enabling the inner sleeve to move axially within the bar hole. A retrieving spring is located between the inner sleeve and the outer sleeve for enabling the inner sleeve to remain outwards in the absence of an external force. The locking rod is provided with an extra portion capable of extending outwards through the axial hole of the outer sleeve. The axial hole is provided in the wall thereof with a recess in which a compression spring and an urging pin are disposed. The extra portion is provided with a horizontal tangent slot engageable with the urging pin so as to arrest the inner sleeve when the inner sleeve is pushed inwardly for a predetermined distance.

2 Claims, 2 Drawing Sheets

PUSH-BUTTON LOCKING DEVICE

FIELD OF THE INVENTION

The present invention relates generally to a locking device, and more particularly to a push-bottom locking device.

BACKGROUND OF THE INVENTION

The Taiwanese Patent Serial Number 80215307, which has been approved and published for public inspection, discloses an improved push-button lock which comprises a locking rod of hollow construction and provided in the surface thereof with a slot and a lock hole. A first rod seat and a second rod seat, which are provided respectively with a retaining body, are fitted over the locking rod. An insertion pin is put through the first rod seat such that the insertion pin is located in the slot, thereby causing the locking rod to join with the first rod seat and to move axially in relation to the first rod seat. The locking rod is provided in the hollow interior thereof with an urging spring having two ends making contact respectively with the front end wall of the locking rod and the insertion pin. The second rod seat has a seat body provided with a small spring and a rod body. In the absence of an external force, the locking rod is urged by the urging spring to extend beyond one end of the outer sleeve of the lock. In the presence of an external force exerting on the locking rod which is therefore forced to move inwardly for a distance, the rod body of the second rod seat is inserted into the lock hole of the locking rod so as to bring about a locking effect.

The prior art locking device described above is defective in design in that the locking rod of a hollow construction is highly vulnerable to breakage, and that the first and the second rod seats are fitted movably over the locking rod before they are disposed in the outer sleeve, thereby making it rather time-consuming to mount various component parts, such as front retaining body, rear retaining body and small spring, in the openings of the first and the second rod seats.

SUMMARY OF THE INVENTION

It is therefore the primary objective of the present invention to provide an improved push-button locking device with a strong locking rod which can not be easily broken.

It is another objective of the present invention to provide an improved push-button locking device, which can be assembled easily and rapidly.

The foregoing objectives of the present invention are attained by an improved push-button locking device, which comprises a locking rod of solid construction and provided integrally at the front segment thereof with a front rod seat extending radially. The locking device of the present invention is characterized in that it comprises an inner sleeve and an outer sleeve, with the inner sleeve intended for use in receiving therein the locking rod, the front and the rear rod seats, the front and the rear retaining tenons, and the urging spring, and with the outer sleeve intended for use in housing the inner sleeve. The outer sleeve is provided in the wall thereof with a bar hole extending axially while the inner sleeve is provided vertically in the wall thereof with a locating pin extending into the bar hole so as to enable the inner sleeve to move axially within a moving range corresponding to the length of the bar hole. Located between the wall of a closed end of the outer sleeve and the relative wall of the inner sleeve is a retrieving spring, which is fitted over an extra portion of the locking rod and extending outwards from the inner sleeve. As a result, the retrieving spring is kept outwards as long as the inner sleeve is not exerted on by an external force. The wall of the closed end of the outer sleeve is provided with an axial hole through which the extra portion of the locking rod is permitted to extend. The axial hole is provided in the wall thereof with a recess in which a biasing spring and an urging pin are disposed. The extra portion of the locking rod is provided with a horizontal tangent slot. As the inner sleeve is forced to move inwardly until such time when the locating pin is caused to press against one end of the bar hole of the outer sleeve, the horizontal tangent slot is caused to move to a position corresponding to the recess. As a result, the urging pin is inserted into the horizontal tangent slot so as to hold the inner sleeve at that position. In other words, a key can be inserted into the lock hole defined by the locking rod and the inner sleeve, so as to turn the locking rod for a predetermined angle to cause the horizontal tangent slot and the urging pin to stay apart. The inner sleeve is then set free to be pushed outwards by the retrieving spring until such time when the locating pin is caused to press against another end of the bar hole of the outer sleeve. The key mentioned above is a ring key similar to the prior art ring key.

DETAILED DESCRIPTION OF THE INVENTION

Figure 1:
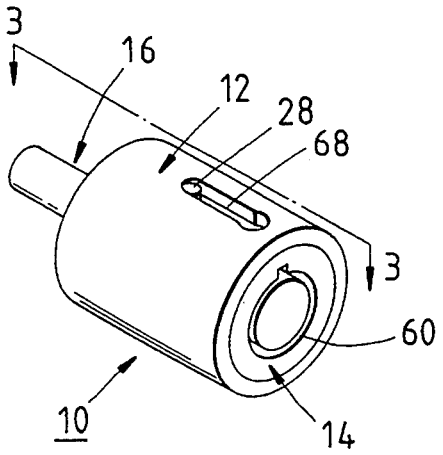
FIG. 1 shows a perspective view of a preferred embodiment in a locking state, according to the present invention.
Figure 2:
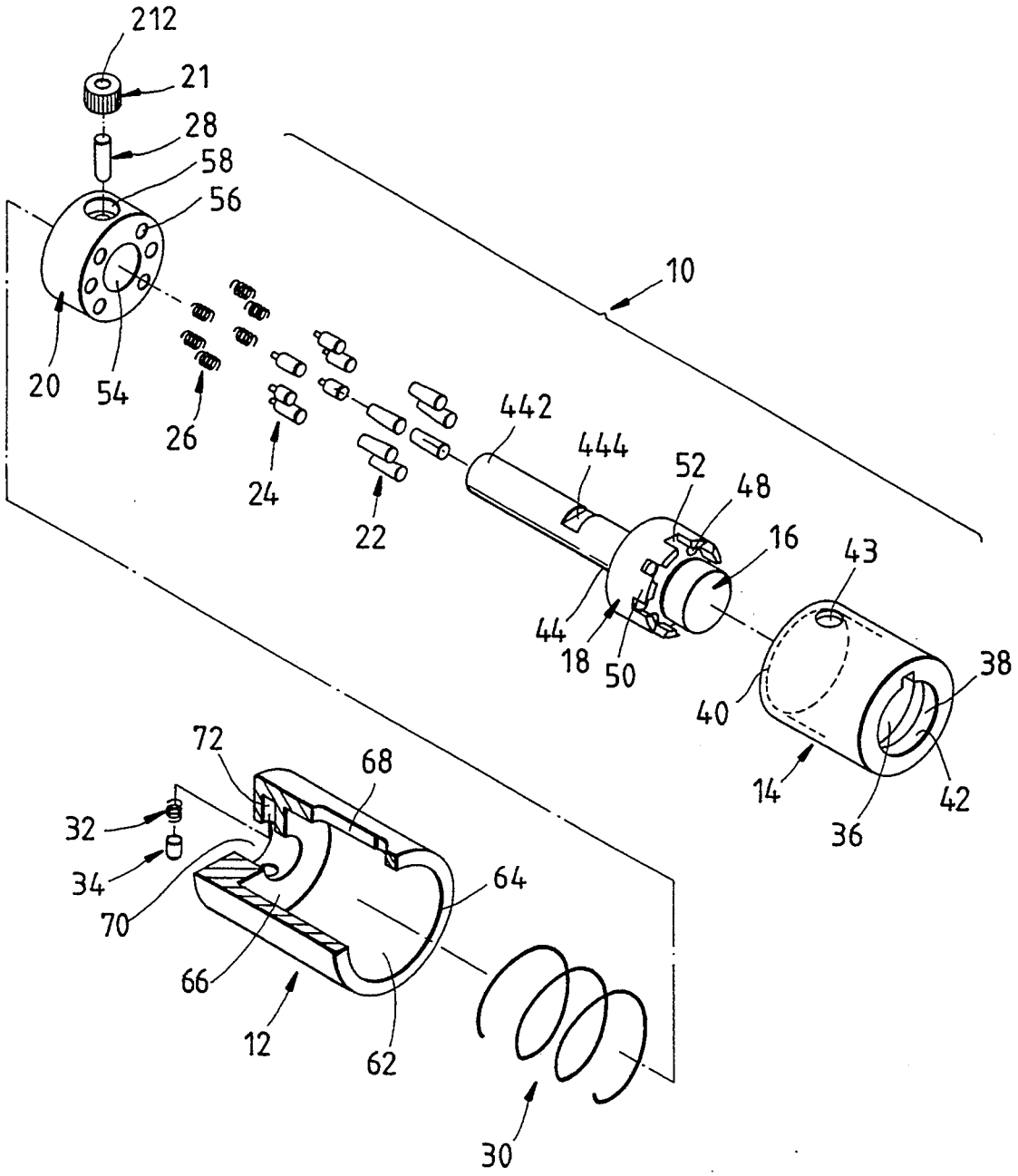
FIG. 2 shows an exploded view of the preferred embodiment in the locking state, according to the present invention.

Referring to FIGS. 1 and 2, a locking device 10 embodied in the present invention is shown to comprise an outer sleeve 12, an inner sleeve 14, a locking rod 16, a front ring seat 18, a rear ring seat 20, a locking pin 21, several front retaining tenons 22, several rear retaining tenons 24, several urging springs 26, a locating pin 28, a retrieving spring 30, a biasing spring 32, and an urging pin 34.

The inner sleeve 14 is provided axially with a receiving space 36 having a front open end 38 and a rear open end 40. The front open end 38 is provided with a lip 42. The inner sleeve 14 is provided in the wall thereof with a through hole 43 adjacent to the rear open end 40.

The locking rod 16 has a rod body 44. The front ring seat 18 is made integrally with the front segment of the rod body 44 and has an outer diameter slightly smaller than the inner diameter of the receiving space 36. In combination, the locking rod 16 and the front ring seat 18 are put into the receiving space 36 through the rear open end 40. The front ring seat 18 is provided with six through holes 48 extending axially and spaced equidistantly. The front ring seat 18 is further provided at one end of the axis thereof with a slotted fringe 50 having six guide slots 52 corresponding respectively in location to the six through holes 48.

The rear ring seat 20 has an outer diameter corresponding to that of the front ring seat 18. The rear ring seat 20 is provided with a ring hole 54, six through holes 56 coaxial respectively with the six through holes 48 and extending from the front end thereof toward the rear end thereof, and a longitudinal hole 58 extending vertically from the side thereof. In combination, the rear ring seat 20 is mounted on the locking rod 16 by means of the ring hole 54 such that the rear ring seat 20 makes contact with the front ring seat 18 and that the rear ring seat 20 is received in the receiving space 31. The locking pin 21 is received in the through hole 43 such that the locking pin 21 is fastened securely in the longitudinal hole 58 for fastening the rear ring seat 20 with the inner sleeve 14.

There are six front retaining tenons 22 of different lengths, which are received respectively in the six through holes 48 of the front ring seat 18. There are six rear retaining tenons 24 of equal length. There are six urging springs 26, which are received respectively along with the six rear retaining tenons 24 in the through holes 56 of the rear ring seat 20. As mentioned previously, the through holes 56 of the rear ring seat 20 are coaxial with the through holes 48 of the front ring seat 18, the six urging springs 26 can urge simultaneously and respectively the six front retaining tenons 22 and the six rear retaining tenons 24, so as to enable each of the front retaining tenons 22 to press against the lip 42 of each of the front open ends 38 of the inner sleeve 14. When a ring key, which is not shown in the drawing and is provided with six projections corresponding in location and length to the six front retaining tenons 22, is inserted into a lock hole 60 formed between the front open end 38 of the inner sleeve 14 and the locking rod 16, as shown in FIG. 1, the six projections of the key can be caused to push the six front retaining tenons 22 along the guide slots 52 until such time when the six projections are located on the interfaces adjacent to the rear ring seat 20. As a result, the locking rod 16 and the front rod seat 18 can be turned by the key. It must be noted here that the foregoing description of the unlocking mechanism is not of a primary concern of the present invention and is as brief as possible.

Figure 3:
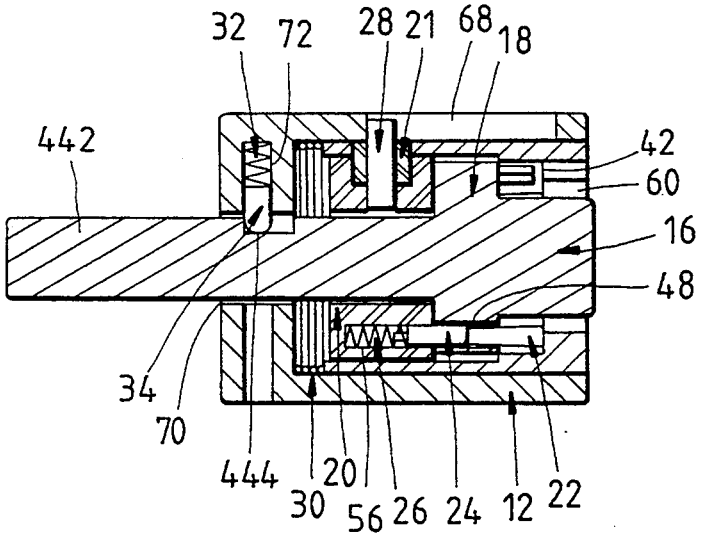
FIG. 3 shows a sectional view of a portion taken along the line 3—3 as shown in FIG. 1.
Figure 4:
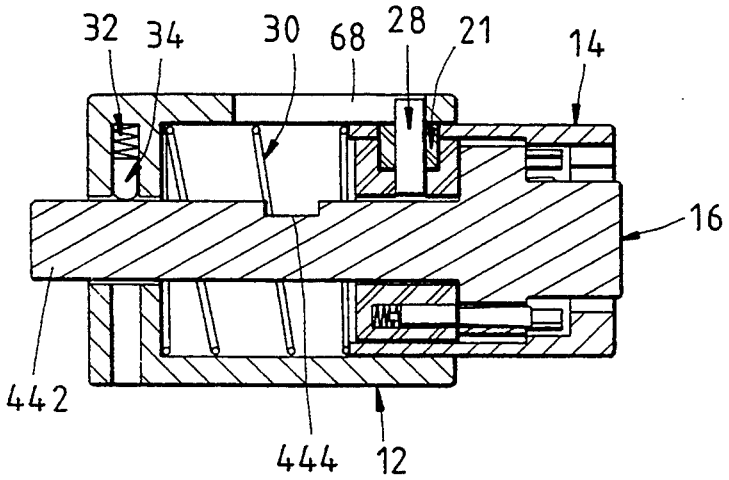
FIG. 4 shows a sectional view of the preferred embodiment of the present invention in an unlocking state, with the sectional view being taken in the direction similar to that of FIG. 3.

The locking device 10 of the present invention is characterized in that the outer sleeve 12 has the receiving space 62 with the inner diameter slightly greater than the outer diameter of the inner sleeve 14, and that the outer sleeve 12 further has a front open end 64 located at one side of the receiving space 62, a rear end wall 66 located at another side of the receiving space 62, and a bar hole 68 disposed in the wall of the outer sleeve 12 such that the bar hole 68 extends axially. The rear end wall 66 is provided with an axial hole 70 which is in turn provided with a recess 72. In combination, the inner sleeve 14 and all component parts contained in the inner sleeve 14 are disposed in the receiving space 62 through the front open end 64. The rod body 44 of the locking rod 16 is provided axially with an extra portion 442, which is put through and beyond the axial hole 70 at such time when the inner sleeve 14 is disposed in the outer sleeve 12. The locating pin 28 is lodged securely in an axial hole 212 of the locking pin 21 such that the locating pin 28 extends into the bar hole 68. As the inner sleeve 14 is caused to move axially, the range of the movement of the inner sleeve 14 is corresponding to the length of the bar hole 68. The retrieving spring 30 is fitted over the extra portion 442 of the locking rod 16 such that both ends of the retrieving spring 30 urge respectively the rear end of the inner sleeve 14 and the rear end wall 66 of the outer sleeve 12. In the absence of an external force, the inner sleeve 14 and the locking rod 16 are urged by the retrieving spring 30 to extend outwards through the front open end 64 of the outer sleeve 12 until such time when the locating pin 28 is caused to press against one end of the bar hole 68. When the inner sleeve 14 is located at this position, the locking device 10 is in an unlocking state, as shown in FIG. 4. The biasing spring 32 and the urging pin 34 are disposed in the recess 72 in that order. The extra portion 442 of the locking rod 16 is provided appropriately with a horizontal tangent slot 444. When the inner sleeve 14 and the locking rod 16 are pushed inwardly by an external force until such time when the locating pin 28 is caused to press against another end of the bar hole 68, the horizontal tangent slot 444 is corresponding in location to the recess 72 so as to enable the urging pin 34 to be retained in the horizontal tangent slot 444. As a result, the inner sleeve 14 and the locking rod 16 are confined to this position for allowing the locking device 10 to switch from an unlocking state to a locking state, as shown in FIG. 3. The locking state of the locking device 10 can be switched to the unlocking state by means of a designated key, which is inserted into the lock hole 60 to turn the locking rod 16 for an appropriate angle so as to cause the urging pin 34 to disengage with the horizontal tangent slot 444, thereby allowing the locking rod 16 and the inner sleeve 14 to be pushed outwards together by the retrieving spring 30.

What is claimed is:

1. An improved push-button locking device comprising:

an inner sleeve having a receiving space extending axially, a front open end and a rear open end which are located respectively at both sides of said receiving space, said front open end being provided with a lip, said inner sleeve being provided in a wall thereof with a through hole adjacent to said rear open end;

a locking rod disposed axially in said receiving space and provided with a rod body having a front segment with which a front ring seat is made integrally such that said front ring seat extends radially, said front ring seat having an outer diameter smaller than an inner diameter of said receiving hole and further having a plurality of through holes extending axially therethrough;

a rear ring seat having an outer diameter corresponding to said outer diameter of said front ring seat and further having a ring hole dimensioned to fit over said locking rod such that said rear ring seat makes contact with said front ring seat and that said rear ring seat is received in said receiving space, said rear ring seat further having a plurality of receiving holes coaxial with said through holes and a longitudinal hole extending vertically from one side thereof;

a plurality of front retaining tenons of different lengths and received respectively in said through holes;

a plurality of rear retaining tenons received respectively in said receiving holes;

a plurality of urging springs received respectively in said receiving holes such that each of said urging springs is located between each of said rear retaining tenons and a bottom of each of said receiving holes;

a locking pin inserted into said through hole of said inner sleeve and said longitudinal hole of said rear ring seat for fastening said rear ring seat with said inner sleeve;

wherein said rod body of said locking rod is provided axially with an extra portion capable of being caused to extend outwards from said rear open end of said inner sleeve, said extra portion being provided with a horizontal tangent slot;

an outer sleeve having a receiving space extending axially, a front open end located at one side of said receiving space and a rear end wall located at another side of said receiving space having an inner diameter greater than an outer diameter of said inner sleeve which is received in said receiving space of said outer sleeve, with said outer sleeve further having a bar hole parallel to an axis thereof, said rear end wall having an axial hole with a diameter greater than an outer diameter of said extra portion so as to enable said extra portion to extend outwards through said axial hole which has a wall provided with a recess;

a locating pin fastened vertically to the wall of said inner sleeve such that said locating pin extends to reach said bar hole for enabling said inner sleeve and said locking rod to move axially inside said outer sleeve in a range corresponding to the length of said bar hole;

a retrieving spring fitted over said extra portion such that both ends of said retrieving spring are in contact with a rear end surface of said rear ring seat and a rear end wall of said outer sleeve for pushing outwards said inner sleeve and said locking rod through said front open end of said outer sleeve; and a biasing spring and an urging pin disposed in that order in said recess, said urging pin capable of being retained in said horizontal tangent slot of said extra portion so as to arrest said inner sleeve and said locking rod at such time when said inner sleeve and said locking rod are pushed inwardly for a predetermined distance, said urging pin further capable of becoming disengaged with said horizontal tangent slot of said extra portion so as to cause said inner sleeve and said locking rod to be pushed outwards by said retrieving spring to cause said locating pin to make contact with one end of said bar hole at such time when said locking rod is turned for a predetermined angle by a designated key.

2. The improved push-button locking device of claim 1 wherein said locking pin is provided with an axial hole in which said locating pin is lodged.

* * * * *